US006189593B1

(12) United States Patent
Katchur et al.

(10) Patent No.: US 6,189,593 B1
(45) Date of Patent: Feb. 20, 2001

(54) INJECTION MOLDED ROLL UP SECURITY CLOSURE

(75) Inventors: Brian R. Katchur, Beaver Meadows; Jack Walsh, Larksville, both of PA (US)

(73) Assignee: Cornell Iron Works, Inc., Mountaintop, PA (US)

( * ) Notice: Under 35 U.S.C. 154(b), the term of this patent shall be extended for 0 days.

(21) Appl. No.: 09/500,674

(22) Filed: Feb. 9, 2000

(51) Int. Cl.[7] ..... E06B 9/08
(52) U.S. Cl. ..... 160/133; 160/229.1; 160/236
(58) Field of Search ..... 160/133, 32, 35, 160/36, 33, 236, 229.1

(56) References Cited

U.S. PATENT DOCUMENTS

| | | | |
|---|---|---|---|
| D. 297,463 | 8/1988 | Greco | D25/50 |
| D. 297,572 | 9/1988 | Greco | D25/50 |
| D. 297,573 | 9/1988 | Greco | D25/50 |
| D. 305,068 | 12/1989 | Greco | D25/50 |
| D. 323,714 | 2/1992 | Greco | D25/50 |
| 634,072 | 10/1899 | Spaulding . | |
| 1,350,919 | 8/1920 | Carlson . | |
| 2,592,888 | 4/1952 | Greegor | 189/78 |
| 3,601,175 | 8/1971 | Wardlaw | 160/133 |
| 3,739,832 | 6/1973 | Sivin | 160/133 |
| 4,120,340 | 10/1978 | Stascavage et al. | 160/133 |
| 4,282,920 | 8/1981 | Kremm | 160/133 |
| 4,345,635 | 8/1982 | Solomon | 160/133 |
| 4,685,484 | 8/1987 | Moneta | 135/117 |
| 5,474,118 | 12/1995 | Hoffman | 160/235 |
| 5,515,902 | 5/1996 | Hoffman | 160/235 |
| 5,601,130 | 2/1997 | Werner et al. | 160/183 |
| 5,611,383 | 3/1997 | Hoffman | 160/133 |
| 5,909,762 | 6/1999 | Denoual et al. | 160/201 |
| 5,915,446 | 6/1999 | De Zen | 160/235 |

*Primary Examiner*—David M. Purol
(74) *Attorney, Agent, or Firm*—Webb Ziesenheim Logsdon Orkin & Hanson, P.C.

(57) ABSTRACT

The present invention is a security closure for a rolling security gate having a plurality of parallel rods. The security closure generally includes a first hollow conduit, a second hollow conduit, and a curved connector piece connecting the first hollow conduit to the second hollow conduit.

20 Claims, 4 Drawing Sheets

INJECTION MOLDED ROLL UP SECURITY CLOSURE

BACKGROUND OF THE INVENTION

1. Field of the Invention

The present invention relates to rolling security gate assemblies and, more particularly, to rolling security gate assemblies having interlocking security closures.

2. Brief Description of the Prior Art

Rolling security gate assemblies are commonly used to barricade openings in structures, such as storefront entrances or window openings. As shown generally in U.S. Pat. No. 3,739,832, rolling security gate assemblies generally include a rolling security gate having a plurality of cylindrical rods connected together by a plurality of interspaced support pieces. The rolling security gate slides in tracks permanently attached to opposing jam portions of an entranceway or window. When access through the entranceway is desired, the rolling security gate is raised, wrapping around a cylindrically-shaped pipe shaft positioned at an apex sill of the entranceway or window. Conversely, when the rolling security gate is deployed to prevent access, the rolling security gate is pulled toward a nadir sill of the entranceway or window and locked in a closed position.

U.S. Pat. Nos. 4,282,920 and 4,120,340 both disclose transparent, planar-shaped security closures that fit between neighboring parallel rods of a rolling security gate. These transparent security closures keep unwanted objects from being inserted between neighboring rods, yet still allow sales merchandise inside a store to be seen by a passing consumer. However, rolling security gates of this type are also difficult to see in poorly lit areas due to the small diameter of the rods and do not warn prospective criminals that the rolling security gate is present. Visually deterring prospective criminals is desirable, especially if the rolling security gate is set back from a store window, because prospective criminals may be less likely to break the store window if they see that a rolling security gate will hamper their ingress into the store after the window is broken. However, in some applications, the visual deterrent should not substantially impair the ability of a consumer, shopper, or other invitee from viewing merchandise located on an opposite side of the security gate.

A problem with rolling security gates having planar-shaped security closures is that the closure pieces prevent the rolling security gate assemblies from rolling compactly around the pipe shaft. This translates into larger gate storage housings which further translates into higher manufacturing and installation costs, especially if a rolling security gate has to be specially made to fit a pre-existing entranceway or window frame. Moreover, a larger gate storage housing is harder to hide from view, making the rolling security gate less attractive.

SUMMARY OF THE INVENTION

The present invention solves the problem associated with rolling security gate assemblies having security closures by providing a security closure having a molded body. The molded body forms a curved connector, a first hollow conduit, and a second hollow conduit. The curved connector has a first end and a second end, with the first end extending between a first endpoint and a second endpoint. The second end is positioned substantially parallel to the first end and extends between a third endpoint and a fourth endpoint. A concave surface and a convex surface connect the first end and the second end. The concave surface faces an imaginary plane passing through the first endpoint and the second endpoint of the first end of the curved connector and the third endpoint and fourth endpoint of the second end of the curved connector.

The first hollow conduit forms a first exterior surface and extends along a first conduit axis, with the first conduit axis passing along the first endpoint of the first end of the curved connector and perpendicular to the second endpoint of the first end of the curved connector. A second hollow conduit forms a second exterior surface and extends along a second conduit axis, with the second conduit axis passing along the third endpoint of the second end of the curved connector and the fourth endpoint of the second end of the curved connector. The second conduit axis is also parallel to the first conduit axis.

The security closure provides a visual deterrent to prospective criminals. The curved connector of the security closure permits the rolling security gate attached thereto to be wrapped more compactly around the cylindrical rolling gate storage shaft when the rolling security gate is retracted into the gate storage housing. The compact wrapping reduces the overall diameter of the gate storage housing. Because rolling security gate assemblies are often used in storefronts or behind glass windows, space considerations have utilitarian, economic, and aesthetic implications.

It is therefore an object of the present invention to provide a security closure device that compactly wraps around a cylindrical gate storage shaft and provides a visual deterrent.

These and other advantages of the present invention will be clarified in the description of the preferred embodiments taken together with the attached drawings in which like reference numerals represent like elements throughout.

DETAILED DESCRIPTION OF THE PREFERRED EMBODIMENTS

Figure 4:
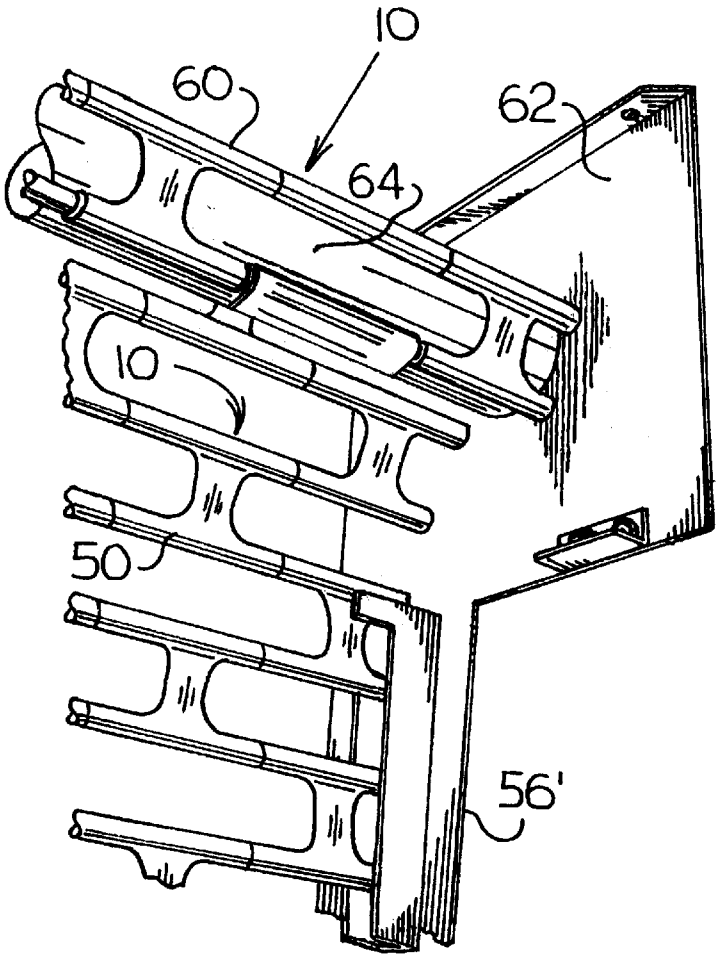
FIG. 4 is a back view of a rolling security gate assembly with the security closures shown in FIGS. 1, 1A, 2, and 3 installed.
Figure 6:
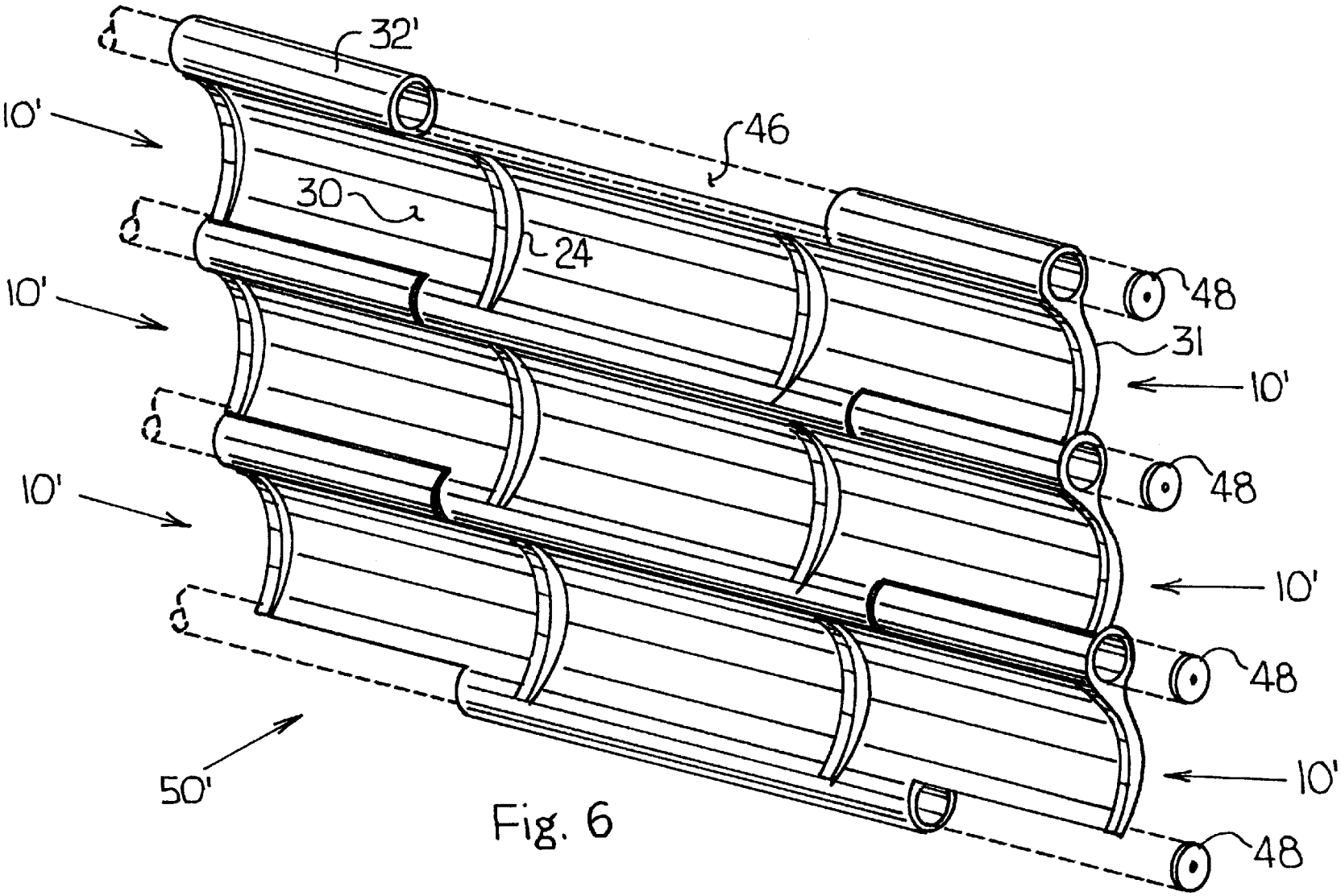
FIG. 6 is a back view of a plurality of the security closures shown in FIG. 5 assembled on a plurality of rods.
Figure 5:
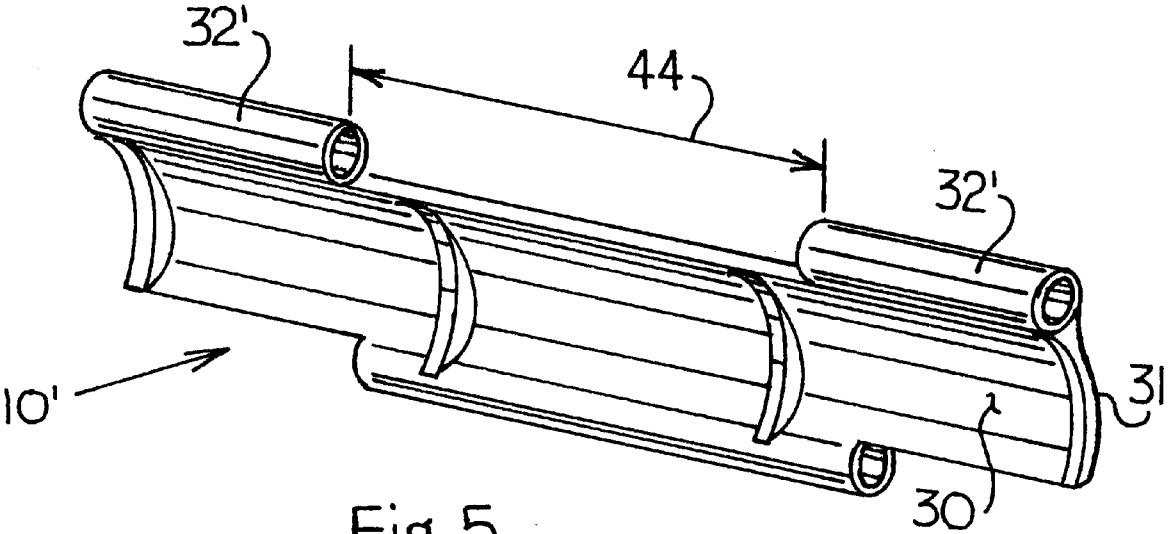
FIG. 5 is a perspective view of a security closure according to a second embodiment of the present invention.
Figure 7:
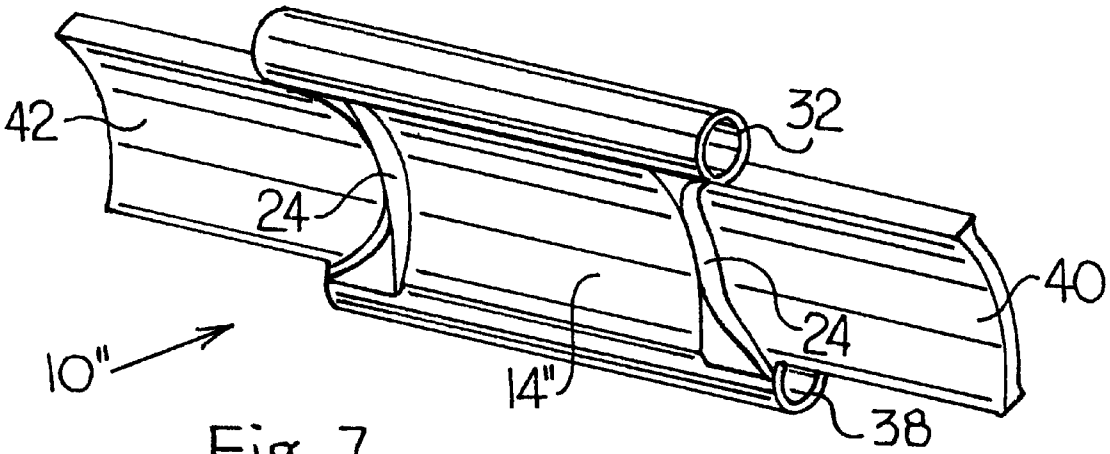
FIG. 7 is a perspective side view of a security closure according to a third embodiment of the present invention.

One embodiment of the present invention is shown in FIGS. 1–4. A second embodiment is shown in FIGS. 5 and 6. A third embodiment is shown in FIG. 7.

Figure 1:
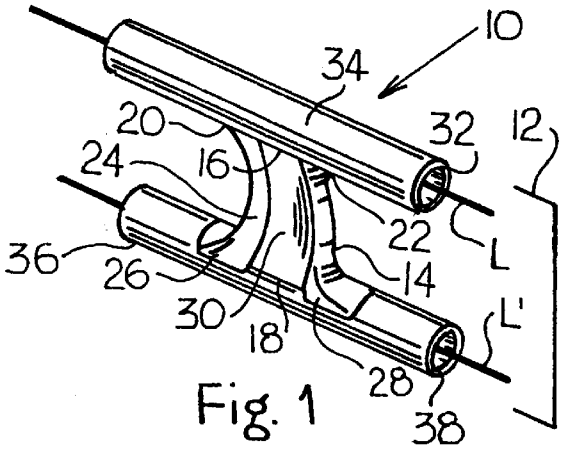
FIG. 1 is a perspective view of a security closure according to a first embodiment of the present invention.

As shown in FIGS. 1–4, and with particular reference to FIG. 1, the present invention is a security closure 10 having a body 12 forming a curved connector 14. The curved connector 14 has a first end 16 and a second end 18. The first end 16 of the curved connector 14 extends between a first endpoint 20 and a second endpoint 22, and is positioned substantially parallel to the second end 18 of the curved connector 14. The second end 18 of the curved connector 14 extends between a third endpoint 26 and a fourth endpoint 28. A concave surface 30 and a convex surface 31 of the curved connector 14 connect the first end 16 of the curved connector 14 to the second end 18 of the curved connector 14. The concave surface faces an imaginary plane IP1 passing through the first endpoint 20 and the second endpoint 22 of the first end 16 of the curved connector 14 and the third endpoint 26 and fourth endpoint 28 of the second end 18 of the curved connector 14. The curvature C of the concave surface 30 is defined by a curvature vector V originating at a point O on the imaginary plane IP1, equidistant from the first and second ends 16, 18 of the curved connector 14. The curvature vector V is not necessarily a radius, and therefore may increase in length D, decrease in length D, or maintain a static length D over the curvature C. Ideally, the length D of the curvature vector V between the point O on the imaginary plane IP1 and an apex A of the curvature C is between ¼ inches and 9/32 inches.

A first hollow conduit 32 forms a first exterior surface 34 and extends along a first hollow conduit axis L, with the first conduit axis L passing along the first endpoint 20 of the first end 16 of the curved connector 14 and the second endpoint 22 of the curved connector 14. The first hollow conduit 32 is preferably a seamless, cylindrical tube.

A second hollow conduit 38 forms a second exterior surface 36 and extends along a second hollow conduit axis L', with the second conduit axis L' passing along the third endpoint 26 of the second end 18 of the curved connector 14, and to the fourth endpoint 28 of the curved connector 14, and positioned parallel to the first conduit axis L. The second hollow conduit 38 is also preferably a seamless, hollow tube.

Figure 1A:
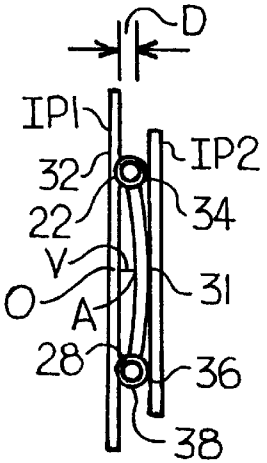
FIG. 1A is a side view of the security closure shown in FIG. 1.

As shown in FIG. 1A, the convex surface 31 of the curved connector 14, the first exterior surface 34 of the first hollow conduit 32, and the second exterior surface 36 of the second hollow conduit 38 all lie in the same imaginary plane IP2. This common alignment produces a uniform contact surface for successive layers of security closures 10 as the security closures 10 are wrapped around the pipe shaft 64 (discussed below), allowing the security closures 10 to be more compactly wrapped around the pipe shaft 64 (discussed below).

In a second embodiment of a security closure 10' shown in FIGS. 5 and 6, the first hollow conduit 32' forms a void 44 that separates the first hollow conduit 32' into two sections. These security closures 10 form an opaque rolling security gate 50', as shown in FIG. 6. In a third embodiment security closure 10", shown in FIG. 7, a third end 40 of the curved connector 14" extends beyond the first hollow conduit 32 and the second hollow conduit 38, and a fourth end 42 of the curved connector 14" extends beyond the first hollow conduit 32 and the second hollow conduit 38. This embodiment also forms an opaque rolling security gate.

Because the first, second, and third embodiments of the security closures 10, 10', 10" are similar in many respects, with like reference numerals indicating like parts, the remaining portion of this document will refer only to the first embodiment security closure 10 and the first embodiment rolling security gate 50 (discussed below). However, unless otherwise noted, reference to the first embodiment security closure 10 also includes reference to the second embodiment security closure 10' and the third embodiment security closure 10". Reference to the first embodiment rolling security gate 50 (discussed below) also includes reference to the second embodiment rolling security gate 50' (discussed below), shown in FIG. 4.

As shown in FIG. 1, the curved connector 14, first hollow conduit 32, and second hollow conduit 38 of the security closure 10 are preferably integrally formed from a non-flexible material, such as nylon, glass-filled nylon, acrylonitrile butadiene styrene, or other suitable material. Reinforcing ribs 24 are also positioned adjacent the concave surface 30 of curved connector 14 to add further strength and stability.

Figure 2:
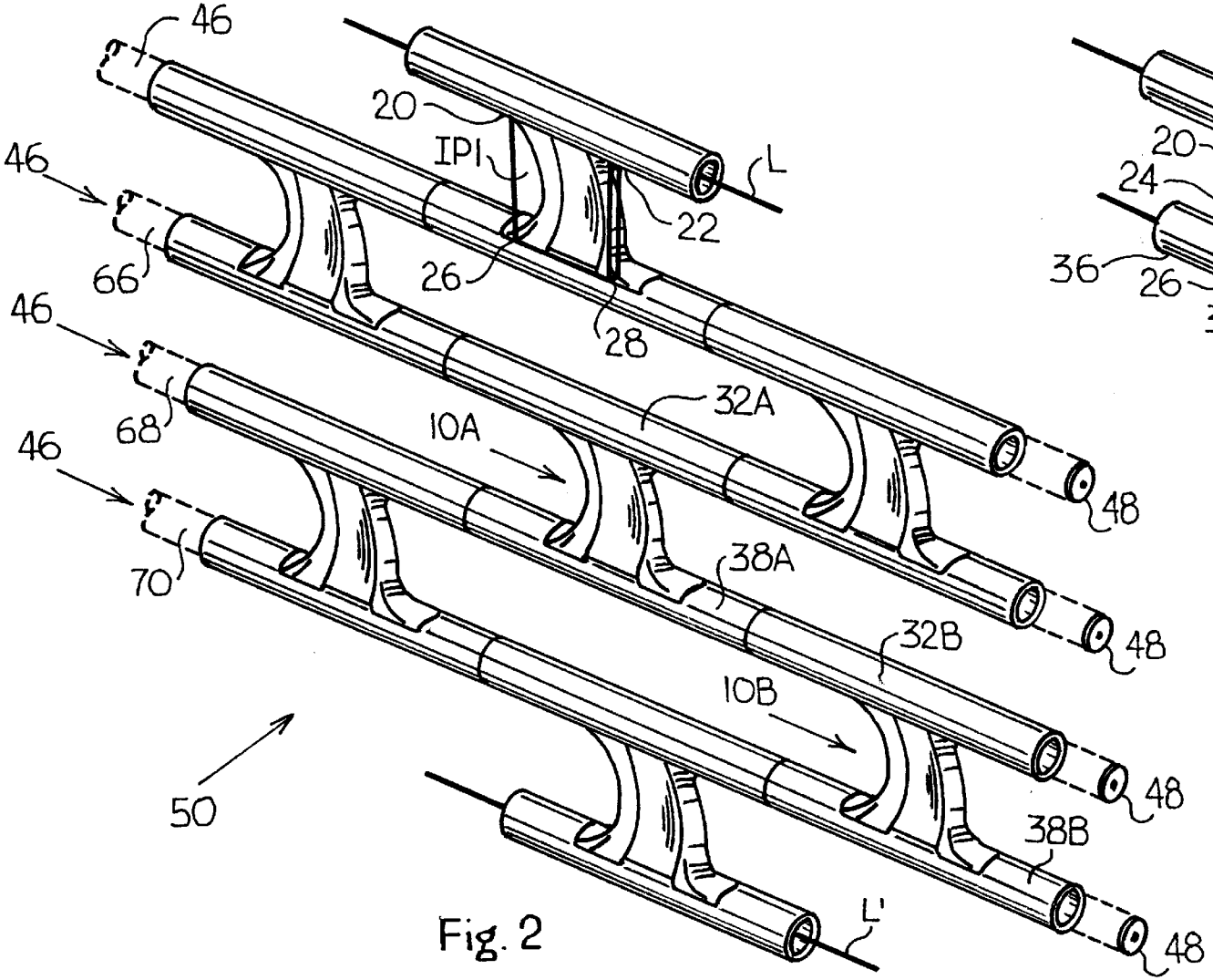
FIG. 2 is a back view of a plurality the security closures shown in FIG. 1 assembled on a plurality of rods.
Figure 3:
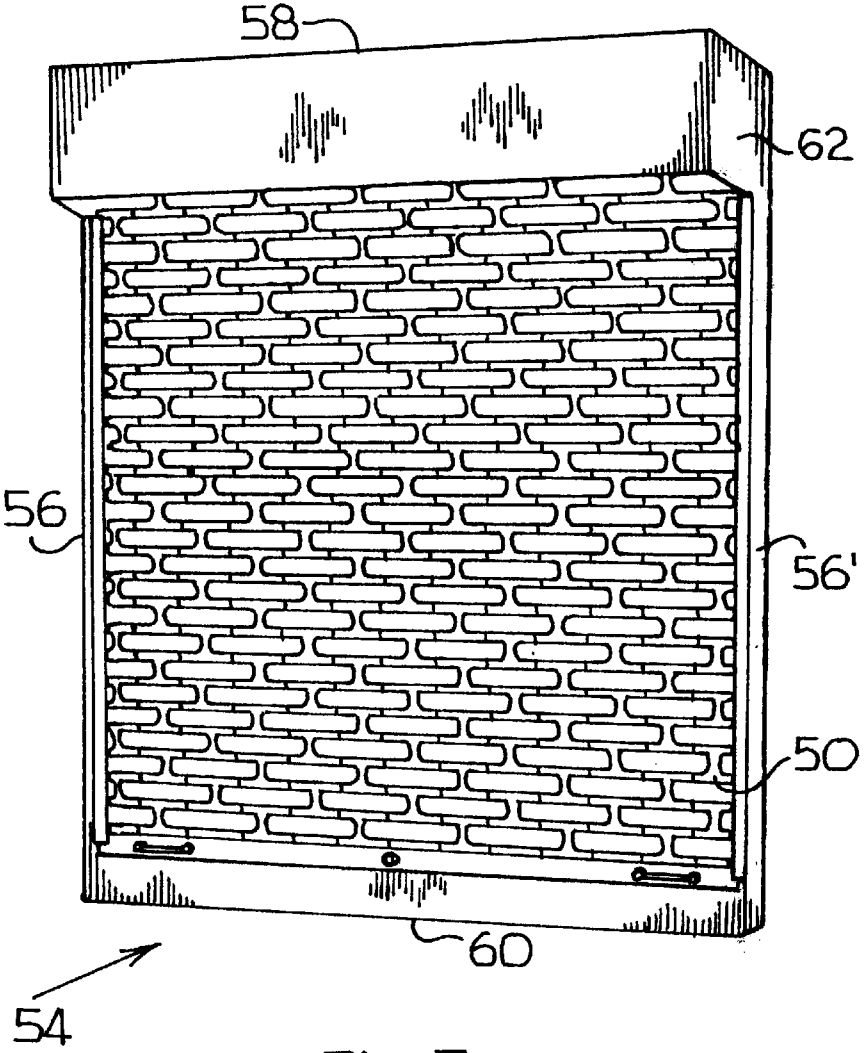
FIG. 3 is a back view of the rolling security gate with the security closures shown in FIGS. 1, 1A, and 2 installed.

As shown in FIG. 2, a plurality of security closures 10, a plurality of rods 46, and a plurality of endcaps 48 are used to create a rolling security gate 50. Each of the security closures 10 is pivotally connected to a pair of rods 46, with endcaps 48 preventing the security closures 10 from falling off the rods 46. As shown in FIGS. 3 and 4, and with continuing reference to FIG. 2, the rolling security gate 50 is part of a rolling gate security assembly 52 having a frame 54 forming opposing parallel sides 56, 56', a first sill member 58, and a second sill member 60. A gate storage housing 62 is positioned adjacent the first sill member 58 of the frame 54 and a cylindrically-shaped pipe shaft 64 is positioned adjacent the gate storage housing 62. The rolling security gate 50 is connected to the pipe storage shaft 64 and is movable with respect to the opposing parallel sides 56, 56' of the frame 54.

As shown in FIG. 2, one method of constructing the rolling security gate 50 includes positioning a first rod 66, a second rod 68, and a third rod 70 parallel to one another. The next step is inserting the first rod 66 into the first hollow conduit 32A of a first security closure 10A. The second rod 68 is then inserted through the second hollow conduit 38A of the first security closure 10A and through the first hollow conduit 32B of a second security closure 10B. The third rod 70 is then inserted through the second hollow conduit 38B of the second security closure 10B. This process is continued, forming the patterns shown in FIGS. 2, 4, and 6, by adding subsequent rows of rods 44, additional endcaps 48, and additional security closures 10, 10', 10".

As described above, the present invention provides a physical barrier that is also a visual deterrent. Moreover, the curvature of the security closures allows a rolling security gate equipped with the security closures to wrap more compactly around a cylindrically-shaped pipe shaft. This efficient wrapping decreases the size of the gate storage housing, resulting in economical and practical advantages.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

We claim:

1. A security closure comprising:

a molded body, the molded body forming a curved connector having a first end extending between a first endpoint and a second endpoint, a second end positioned substantially parallel to the first end and extending between a third endpoint and a fourth endpoint, a concave surface and a convex surface connecting the first end and the second end, the concave surface facing an imaginary plane passing through the first endpoint and the second endpoint of the first end of the curved connector and the third endpoint and fourth endpoint of the second end of the curved connector;

a first hollow conduit forming a first exterior surface and extending along a first conduit axis, with the first conduit axis passing along the first endpoint of the first end of the curved connector and the second endpoint of the first end of the curved connector; and a second hollow conduit forming a second exterior surface and extending along a second conduit axis, with the second conduit axis passing along the third endpoint of the second end of the curved connector and the fourth endpoint of the second end of the curved connector, and positioned parallel to the first conduit axis.

2. The security closure as claimed in claim 1 wherein the first hollow conduit forms a void that separates the first hollow conduit into two sections.

3. The security closure as claimed in claim 1 wherein a third end of the curved connector extends beyond the first hollow conduit and the second hollow conduit and a fourth end of the curved connector extends beyond the first hollow conduit and the second hollow conduit.

4. The security closure as claimed in claim 1 further comprising reinforcing ribs positioned adjacent the concave surface of the curved connector.

5. The security closure as claimed in claim 1 wherein the convex surface of the curved connector, the first exterior surface of the first hollow conduit, and the second exterior surface of the second hollow conduit all lie in the same plane.

6. The security closure as claimed in claim 1 wherein a curvature of the concave surface of the curved connector is defined by a curvature vector originating at a point on the imaginary plane, equidistant from the first and second ends of the curved connector, wherein the length of the curvature vector between the point on the imaginary plane and an apex of the concave surface is between ¼ inches and 9/32 inches.

7. The security closure as claimed in claim 1 wherein the molded body is made from a material selected from the group consisting of nylon, glass-filled nylon, and acrylonitrile butadiene styrene.

8. A rolling security gate assembly comprising:

a frame having opposing parallel sides, a first sill member, and a second sill member;

a gate storage housing positioned adjacent the first sill member of the frame;

a pipe shaft positioned adjacent the gate storage housing;

a rolling security gate connected to the pipe shaft and movable with respect to the opposing jam members of the frame, the rolling security gate having at least one pair of rods, a plurality of security closures pivotally connected to the at least one pair of rods, with each security closure having a body forming a curved connector having a first end extending between a first endpoint and a second endpoint, a second end positioned substantially parallel to the first end and extending between a third endpoint and a fourth endpoint, a concave surface and a convex surface connecting the first end and the second end, the concave surface facing an imaginary plane passing through the first endpoint and the second endpoint of the first end of the curved connector and the third endpoint and fourth endpoint of the second end of the curved connector;

a first hollow conduit forming a first exterior surface and extending along a first conduit axis, with the first conduit axis passing along the first endpoint of the first end of the curved connector and the second endpoint of the first end of the curved connector; and a second hollow conduit forming a second exterior surface and extending along a second conduit axis, with the second conduit axis passing along the third endpoint of the second end of the curved connector and the fourth endpoint of the second end of the curved connector, and positioned parallel to the first conduit axis.

9. The rolling security gate as claimed in claim 8 wherein the first hollow conduit forms a void that separates the first hollow conduit into two sections.

10. The rolling security gate as claimed in claim 8 wherein a third end of the curved connector extends beyond the first hollow conduit and the second hollow conduit and a fourth end of the curved connector extends beyond the first hollow conduit and the second hollow conduit.

11. The rolling security gate as claimed in claim 8 further comprising reinforcing ribs positioned adjacent the concave surface of curved connector.

12. The rolling security gate as claimed in claim 8 wherein the convex surface of the curved connector, the first exterior surface of the first hollow conduit, and the second exterior surface of the second hollow conduit all lie in the same plane.

13. The rolling security gate as claimed in claim 8 wherein a curvature of the concave surface of the curved connector is defined by a curvature vector originating at a point on the imaginary plane, equidistant from the first and second ends of the curved connector, wherein the length of the curvature vector between the point on the imaginary plane and an apex of the concave surface is between ¼ inches and 9/32 inches.

14. The security closure as claimed in claim 8 wherein the molded body is made from a material selected from the group consisting of nylon, glass-filled nylon, and acrylonitrile butadiene styrene.

15. A security closure for a rolling security gate comprising:

a molded body, the molded body forming a curved connector having a first end extending between a first endpoint and a second endpoint, a second end positioned substantially parallel to the first end and extending between a third endpoint and a fourth endpoint, a concave surface and a convex surface connecting the first end and the second end, the concave surface facing an imaginary plane passing through the first endpoint and the second endpoint of the first end of the curved connector and the third endpoint and fourth endpoint of the second end of the curved connector;

a first hollow conduit forming a first exterior surface and extending along a first conduit axis, with the first conduit axis passing along the first endpoint of the first end of the curved connector and the second endpoint of the first end of the curved connector; and a second hollow conduit forming a second exterior surface and extending along a second conduit axis, with the second conduit axis passing along the third endpoint of the second end of the curved connector and the fourth endpoint of the second end of the curved connector, and positioned parallel to the first conduit axis, wherein the concave surface faces an imaginary plane passing through the first endpoint and the second endpoint of the first end of the curved connector and the third endpoint and fourth endpoint of the second end of the curved connector, the curvature of the concave surface of the curved connector is defined by a curvature vector originating at a point on the imaginary plane, equidistant from the first and second ends of the curved connector, the length of the curvature vector between the point on the imaginary plane and an apex of the concave surface is between ¼ inches and 9/32 inches, and the convex surface of the curved connector, the first exterior surface of the first hollow conduit, and the second exterior surface of the second hollow conduit all lie in the same plane.

16. The security closure as claimed in claim 15 wherein the first hollow conduit forms a void that separates the first hollow conduit into two sections.

17. The security closure as claimed in claim 15 wherein a third end of the curved connector extends beyond the first hollow conduit and the second hollow conduit and a fourth end of the curved connector extends beyond the first hollow conduit and the second hollow conduit.

18. The security closure as claimed in claim 15 further comprising reinforcing ribs positioned adjacent the concave surface of curved connector.

19. The security closure as claimed in claim 15 wherein the curved connector is a solid piece.

20. The security closure as claimed in claim 15 wherein the molded body is made from a material selected from the group consisting of nylon, glass-filled nylon, and acrylonitrile butadiene styrene.

* * * * *